US011358683B2

(12) United States Patent
Perkins

(10) Patent No.: US 11,358,683 B2
(45) Date of Patent: Jun. 14, 2022

(54) METHOD AND APPARATUS FOR RECONFIGURABLE BOAT DECK MODULES

(71) Applicant: James M Perkins, Pewaukee, WI (US)

(72) Inventor: James M Perkins, Pewaukee, WI (US)

( * ) Notice: Subject to any disclaimer, the term of this patent is extended or adjusted under 35 U.S.C. 154(b) by 217 days.

(21) Appl. No.: 16/518,429

(22) Filed: Jul. 22, 2019

(65) Prior Publication Data

US 2021/0024177 A1 Jan. 28, 2021

(51) Int. Cl.

| | |
|---|---|
| ***B63B 29/06*** | (2006.01) |
| *B63B 35/34* | (2006.01) |
| *B63B 29/04* | (2006.01) |

(52) U.S. Cl.

CPC ..... *B63B 29/06* (2013.01); *B63B 35/34* (2013.01); *B63B 2029/043* (2013.01); *B63B 2029/046* (2013.01)

(58) Field of Classification Search

CPC ... B63B 29/06; B63B 2025/285; B63B 25/18; B63B 35/34; B63B 2029/043; B63B 2029/046; B60P 7/0807

See application file for complete search history.

(56) References Cited

U.S. PATENT DOCUMENTS

| | | | | | |
|---|---|---|---|---|---|
| 2,373,698 | A * | 4/1945 | Mcgeary | B63B 29/06 | 361/216 |
| 4,322,192 | A * | 3/1982 | Zavada | B60P 7/0807 | 248/501 |
| 4,673,155 | A | 6/1987 | Binder | | |
| 4,892,052 | A | 1/1990 | Zook et al. | | |
| 5,622,404 | A | 4/1997 | Menne | | |
| 5,799,605 | A | 9/1998 | Huse | | |
| 5,826,850 | A * | 10/1998 | Goldsmith | B60N 2/146 | 248/415 |
| 5,833,385 | A * | 11/1998 | Carnahan | B63B 29/06 | 403/326 |
| 5,971,684 | A * | 10/1999 | Wang | B60P 7/0807 | 410/107 |
| 6,109,189 | A | 8/2000 | Tarver | | |
| 6,146,218 | A | 11/2000 | White | | |
| 6,302,358 | B1 * | 10/2001 | Emsters | B64C 1/20 | 244/137.1 |
| 6,345,581 | B2 | 2/2002 | Blanchard | | |

(Continued)

OTHER PUBLICATIONS

US 5,517,466 Aug. 2015, Wizorek et al. (withdrawn)

*Primary Examiner* — Andrew Polay

(74) *Attorney, Agent, or Firm* — Ryan Kromholz & Manion, S.C.

(57) ABSTRACT

The present invention comprises a method, apparatus, and system for modular mounting of typical pontoon or deck boat furniture and accessories including, but not limited to, seats, loungers, helm, bars, tables, fishing pedestals, sun pads storage bins, privacy curtains, lighting fixtures, and the like. The present invention allows customers to easily reconfigure the cockpit as needs or preferences change without leaving unwanted holes in the boat deck. The present invention also incorporates tool-free mounting devices arranged in a grid pattern that allows flexible placement and orientation of typical pontoon boat furniture and accessories. Further, the present invention permits streamlined manufacture by use of uniform, interchangeable inserts and modules.

11 Claims, 10 Drawing Sheets

(56) References Cited

U.S. PATENT DOCUMENTS

| | | | | |
|---|---|---|---|---|
| 6,739,281 | B1 * | 5/2004 | Grimes | B63B 29/06 114/364 |
| 6,766,759 | B2 | 7/2004 | Eck et al. | |
| 6,886,490 | B2 | 5/2005 | Aube et al. | |
| 7,066,548 | B2 | 6/2006 | Butter | |
| 7,651,305 | B1 * | 1/2010 | Boyd | B61D 45/001 410/111 |
| 7,686,551 | B2 * | 3/2010 | Grasso | B60P 7/0807 410/107 |
| 7,913,637 | B2 | 3/2011 | Roehm, II et al. | |
| 8,028,641 | B1 | 10/2011 | Sly | |
| 8,291,851 | B2 | 10/2012 | Strahm et al. | |
| 8,516,971 | B1 * | 8/2013 | Natoce | B63B 17/00 114/85 |
| 9,045,197 | B2 | 6/2015 | Chen | |
| 9,475,554 | B2 | 10/2016 | Heimer | |
| 9,487,273 | B1 | 11/2016 | Eekhoff et al. | |
| 9,623,936 | B2 | 4/2017 | Chen | |
| 9,862,464 | B2 | 1/2018 | Schmidt | |
| 9,937,983 | B1 | 4/2018 | Duke et al. | |
| 9,981,721 | B2 | 5/2018 | Deurr et al. | |
| 2008/0156233 | A1 * | 7/2008 | Paddock | B63B 29/06 108/44 |
| 2011/0210227 | A1 * | 9/2011 | Burg | B60P 7/0807 248/499 |
| 2013/0280475 | A1 * | 10/2013 | Champion | B32B 3/06 428/100 |
| 2017/0320578 | A1 * | 11/2017 | Cooke | B64D 11/0601 |
| 2021/0107605 | A1 * | 4/2021 | Enyart | B63B 35/38 |

* cited by examiner

METHOD AND APPARATUS FOR RECONFIGURABLE BOAT DECK MODULES

BACKGROUND OF THE INVENTION

Pontoon boats are used for a number of purposes. First, like any boat, they are designed for transport across a body of water. Unlike some other boats, however, pontoon boats are particularly versatile. In addition to mere transport, they can be used for tubing, swimming, and other water activities. They can also be used for relaxing pastimes such as fishing, reading, or sunbathing. Pontoon boats can be used to host a small party or dinner. Pontoon boats are also useful for sight-seeing. Pontoon boats further have the advantage of being easy to board and providing significant storage.

Traditional pontoon boat design requires customers to choose the seating, helm, and other deck modules to be used, and in what configuration they will be installed, at the time of purchase. Deck modules are typically permanently or semi-permanently secured to the deck of the boat using power tools and fasteners that are difficult to remove. This mounting method is not designed to be reconfigured and, if modules are removed, would leave objectionable holes in the floor covering and deck of the boat.

During the course of ownership, or even between boat outings, a boat owner's needs may change as to how they wish to use the cockpit space on the boat, i.e., the deck area inside the perimeter of the boat. Boat decks are typically custom outfitted with the customer's choice of trim packages and amenities. The customer is also able to customize the furniture elements to be installed. For example, the customer could order a pair of captain's chairs or a two-person bench seat.

In addition, some chairs on a boat deck can be removable, foldable, adjustable, or the like. However, once the boat is custom manufactured, the furniture and module elements are not designed to be easily rearranged or removed. The customer must therefore decide, prior to purchase, on a single preferred configuration of seats, loungers, couches, and the like.

Unfortunately, the chosen configuration may not be suitable for each activity in which the boater wishes to engage. For example, a party may be best served by seating facing one another for easy conversation. Yet if that same boat owner were to take a group out sight-seeing, the "party" configuration may require guests to turn in their chair for best viewing outside the boat.

Likewise, a swimming and sunbathing configuration, which may include reclining lounge chairs, a sun deck or sun shade, and/or a changing station, may be different from a fishing configuration, which might include swivel and/or raised high-back stools along the perimeter of the boat facing the water. In a fishing configuration, a boat might also include cooler modules for bait and fresh-caught fish.

To get the maximum out of an investment in a pontoon boat, it is considered beneficial to be able to switch out and re-arrange modules to suit the use at hand and the changing preferences of the owner.

SUMMARY OF THE INVENTION

The invention comprises a method, apparatus, and system for a modular mounting of pontoon boat components, including but not limited to, seats, loungers, helm, bars, tables, fishing pedestals, sun pads storage bins, privacy curtains, and lighting elements. The invention allows a boater to easily reconfigure a boat as the person's needs or preferences change, without leaving unwanted holes in the boat deck.

DESCRIPTION OF THE PREFERRED EMBODIMENT

The present invention allows for flexible placement and orientation of typical pontoon boat components arranged in a grid pattern. The invention further allows easy removal and installation of components, preferably incorporating tool-free mounting mechanisms.

Figure 1:
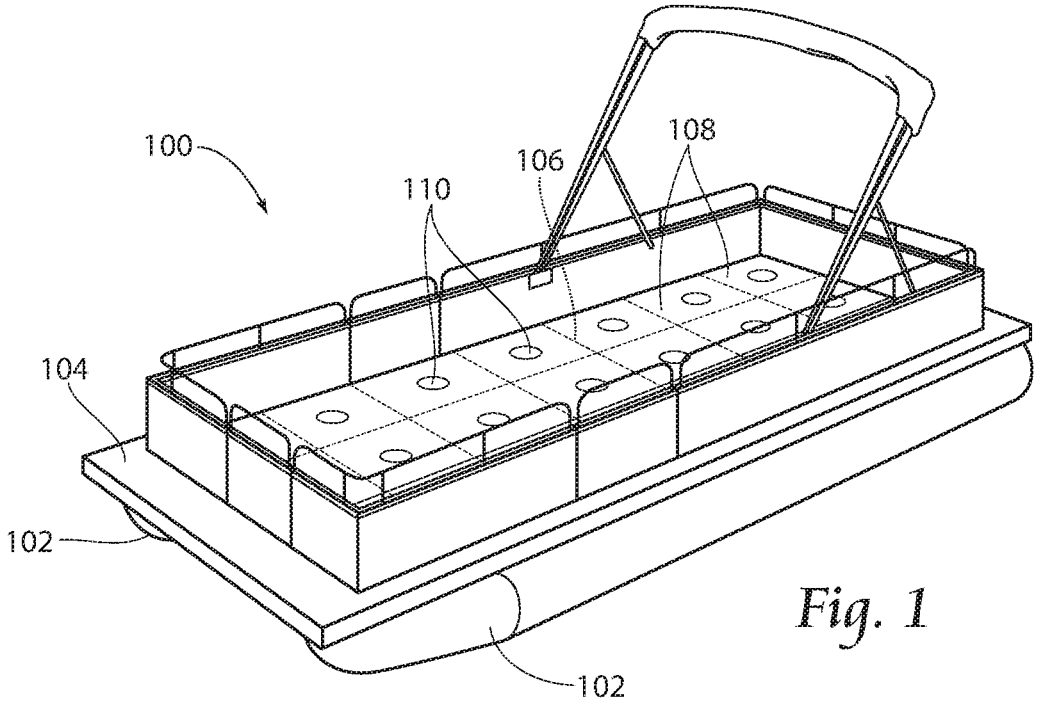
FIG. 1 is a perspective view of a pontoon boat.
Figure 2:
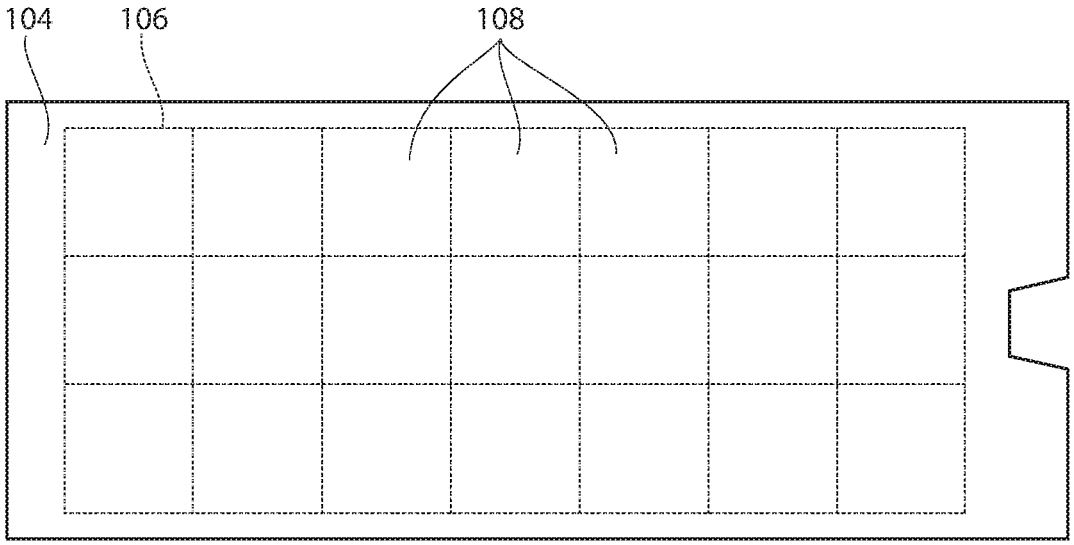
FIG. 2 is a top view illustrating a virtual mounting grid in phantom lines.
Figure 3:
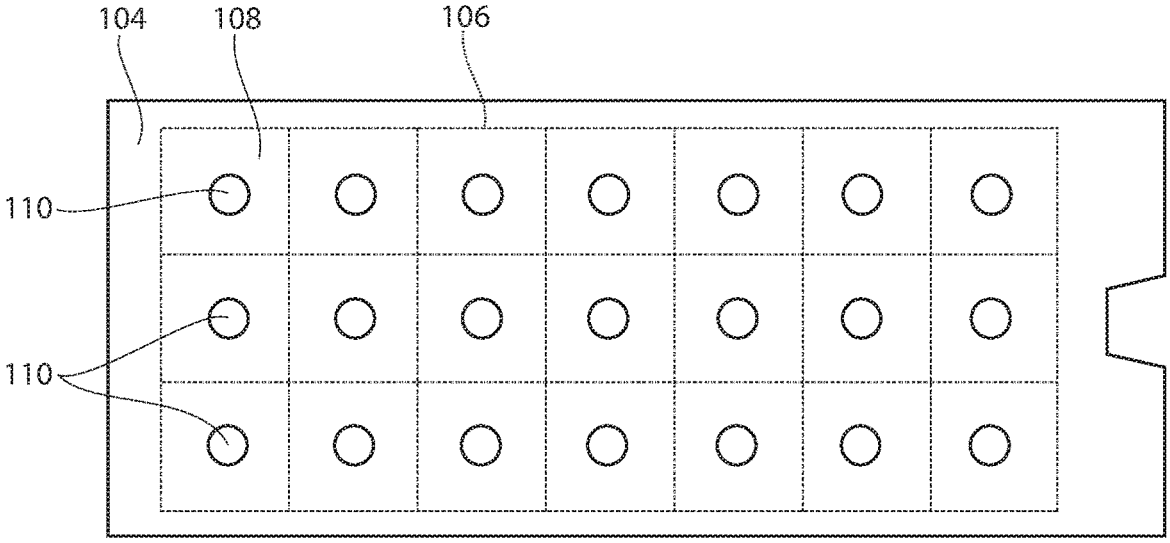
FIG. 3 is a top view of a boat deck showing a series of mounting receptacles.
Figure 4:
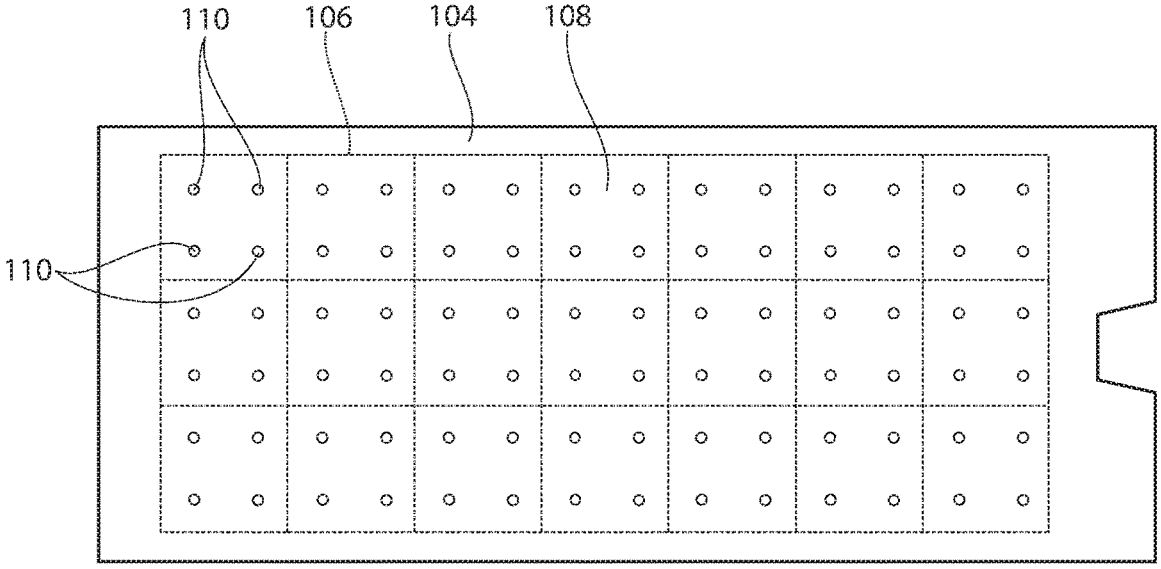
FIG. 4 is a top view of a boat deck showing an alternate series of mounting receptacles within each grid segment.

Although the invention should not be considered confined to pontoon boats, but rather to any boat with a deck construction, a pontoon boat 100 is shown in FIG. 1 as illustrative of the invention. Boat 100 comprises a pair of pontoons 102 and a deck 104. As seen in FIGS. 2-4, in the present invention, deck 104 is divided by a virtual grid 106 into approximately equal-sized segments 108. Each segment 108 contains a floor receptacle 110 (or set of receptacles, as will be discussed later) for a mounting a single deck module 112.

The boat 100 shown in the drawings of the present application has a 3×7 grid 106 of 2'7" segments 108. This layout may be appropriate for a boat 100 having an 8'6" beam and an overall length of ~22' including bow and stern platforms. The deck 104 of this particular boat 100 may therefore be fitted with up to 21 individual modules 112 in any of the 21 available segments 108. Of course the scope of the invention includes variations in the number or size of grid segments 108 depending on the size of deck 104 or the preference of the customer.

As noted, each receptacle 110 is designed to receive a module 112. Turning now to FIGS. 5A-5D, a variety of modules are proposed. Various module types will be discussed below, beginning with helm 112A.

Helm 112*a* includes such requirements as a captain's chair, instrument panel, and controllers. These could be made modular to permit easy disconnection and reconnection of needed elements for helm 112*a*.

Figure 5A:
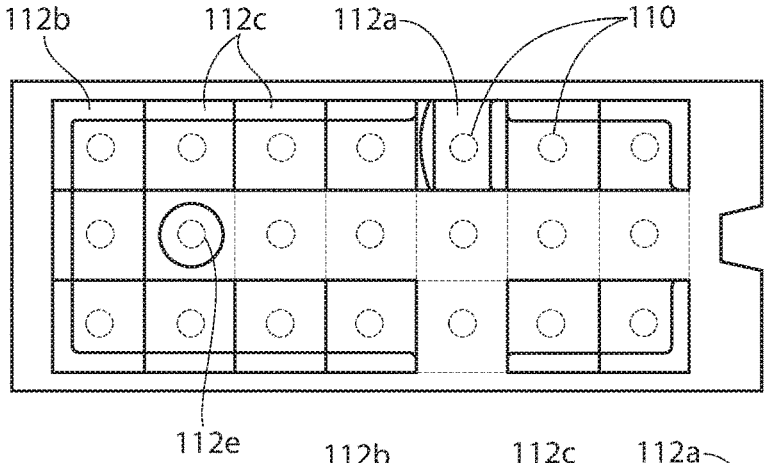
FIGS. 5A, 5B, 5C, and 5D are top views of deck layout and module options possible as a result of the invention.
Figure 5B:
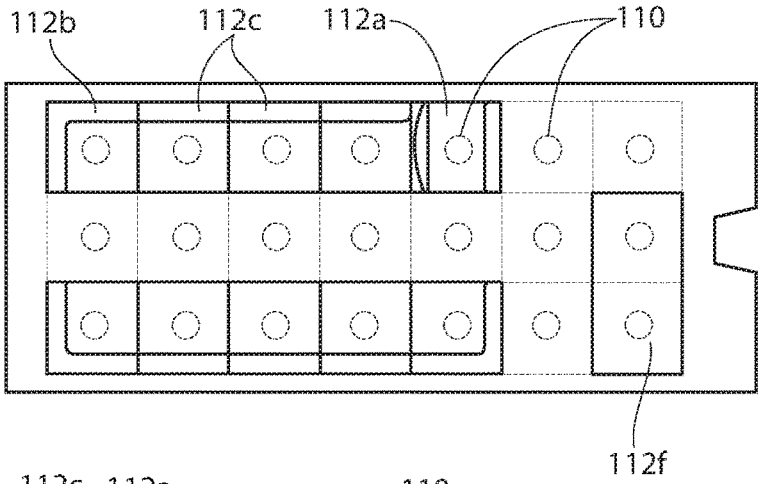

Turning to FIGS. 5A-5D, modules 112 include corner seat 112*b* (with side and back attachments), side seat 112*c* (with back attachment), and seat 112*d* (no back or side attachments). This way boat 100 may be arranged with seats facing inside as seen in FIGS. 5A and 5B, or as arranged as in FIGS. 5C and 5D such that at least some seats face the front or bow.

FIG. 5A also shows modules such as a table 112*e*, which could alternately be replaced with an umbrella or the like. FIG. 5B also shows a double-sized deck element 112*f*, elevated or proximate to deck 104, which may be a sun-pad or the like. The list of options provided herein is not meant to be limiting, only illustrative of some seating, storage, and other module possibilities available.

Figure 5C:
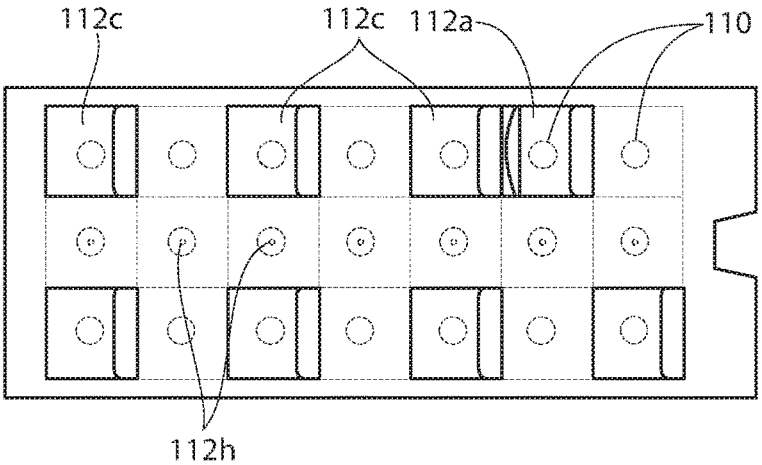
Figure 5D:
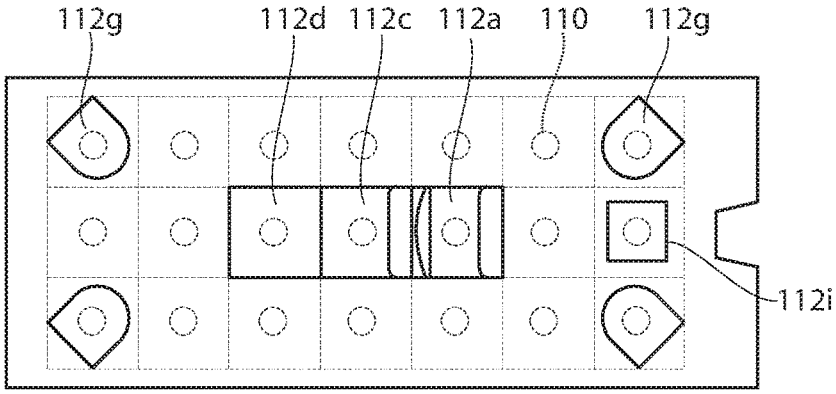

FIG. 5D shows deck 104 having rotating swiveling seats 112*g* and a lounge chair arrangement comprising a module with a side attachment 112*c* and a cushion seat 112*d*. Modules 112 may be equipped with gripping handles (not shown) for easy removal. The shape of modules 112 need not be square and need not extend to the edges of the perimeter of segments 108. This is illustrated in FIGS. 5A (table 112*e*) and FIG. 5D (storage 112*i*).

Modules 112 can be attached to each other or located adjacent to each other to provide loungers, couches, or beds. Each module 112 can be oriented and rotated by 90 degrees for forward-facing, rear-facing, outside-facing seating, and inside-facing seating. As previously noted, other types of modules are contemplated. These could include fishing pedestals, storage bins, privacy curtains, and lighting elements, among others. Again, the options provided herein are illustrative, not limiting.

Referring to FIG. 3, in one embodiment of the invention, a center receptacle 110 is found in each segment 108. FIG. 4 shows a second embodiment in which multiple receptacles 110 are found in each segment 108. The option for multiple receptacles within each segment 108 permits the insertion of modules 112 that reach over a first segment 108 into one or more other segments 108 either partially or fully.

Figure 6A:
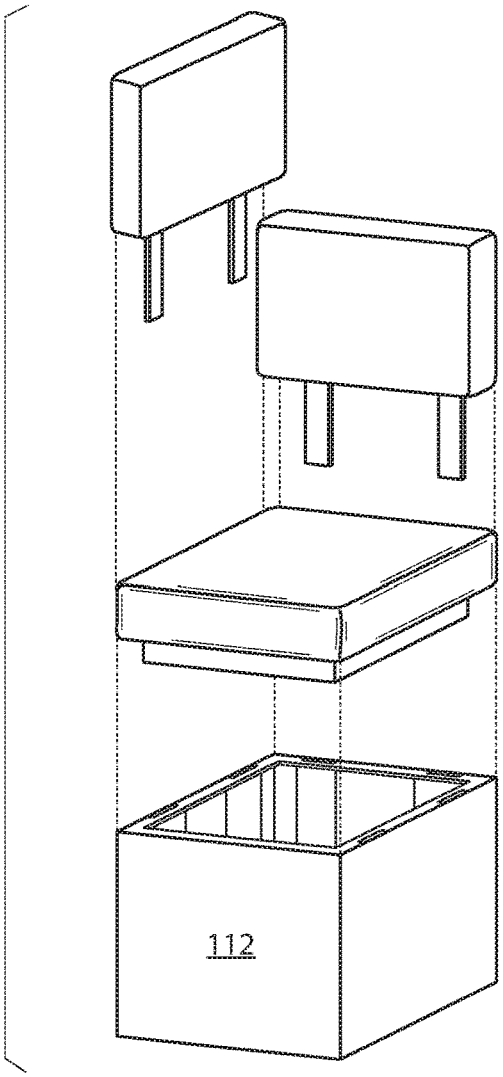
FIG. 6A is an exploded view of a seat module with optional back and cushion side attachments.

Turning to FIG. 6A, modules 112, may be provided with a number of options such as different seat cushions C, cushion backs B, and cushion sides S. Naturally, other module options may be available, and a number of ways to attach such options are possible.

Figure 6B:
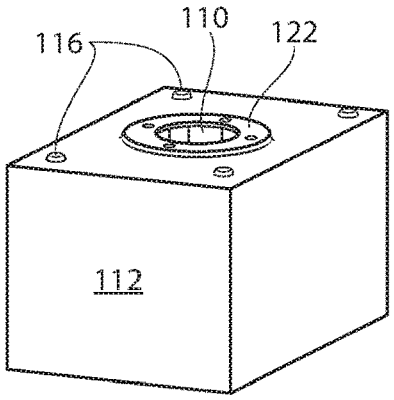
FIG. 6B is a perspective bottom view showing a first embodiment of the bottom of a seat module.
Figure 6C:
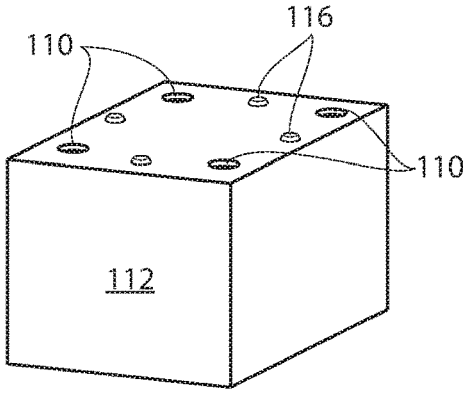
FIG. 6C is a perspective bottom view showing a second embodiment of the bottom of a seat module.

FIG. 6B illustrates the bottom of a module of a first embodiment and FIG. 6C illustrates the bottom of a module of a second embodiment. In FIG. 6B, module 112 has a single, center receptacle 110 sized to be used with a single insert 130. See FIGS. 3 and 7-11. In FIG. 6C, module 112 has a plurality of receptacles 110 to be used with a corresponding number of inserts 130. See FIGS. 4 and 12-18. Receptacles 110 and inserts 130 are designed to be equally spaced from one another and are sized to accommodate and secure the plurality of receptacles provided. In both embodiments, feet 116 may be provided.

In the multi-receptacle arrangement shown herein, each segment 108 is 31" square, the spacing of receptacles is 7¼" from the perimeter and 15½" from one another. This permits modules to straddle two or more segments 108.

Ease of installation, removal and re-installation of modules 112 is another consideration. For the purpose of the present description, "tool" will refer to traditional tools such as screwdrivers, whether powered or manual. In the ideal "tool-free" installation, the user can install entirely by hand. Another method of installation considered "tool-free" comprises the use of "objects" for replacing tools as defined, using a readily available object such as a coin or bottle opener. In a "tool-less" method, which would also fall within the scope of the invention, a minimum number of standard tools are required for installation.

The number of receptacles 110 per segment 108 does not limit the invention; any number that achieves the benefits of the invention is suitable. Further, there are numerous options for removably connecting an object to an immovable base, all of which should be understood to meet the needs of the invention.

In one embodiment of the invention, floor receptacles 110 are provided in bores of deck 104, secured with mounting structures 120 and 122, and intended to be semi-permanent. Receptacle 110, being essentially a void, permits water to drain from deck 104 through the space created by the support structure typically found between deck 104 and pontoons 102. For a different type of deck boat, not shown, water might drain from deck 104 into the bilge of a boat hull.

Note also that a deck covering 114 is contemplated to cover deck 104, except for at receptacles 110. Receptacles 110 accept different types of inserts, generally designated 130. In a first embodiment, these include, but are not limited to, a hold down 132, a pedestal 134, and a plug 136. In a second embodiment, inserts 130 include, but are not limited to, a hold down 142 and plug 144.

Figure 7:
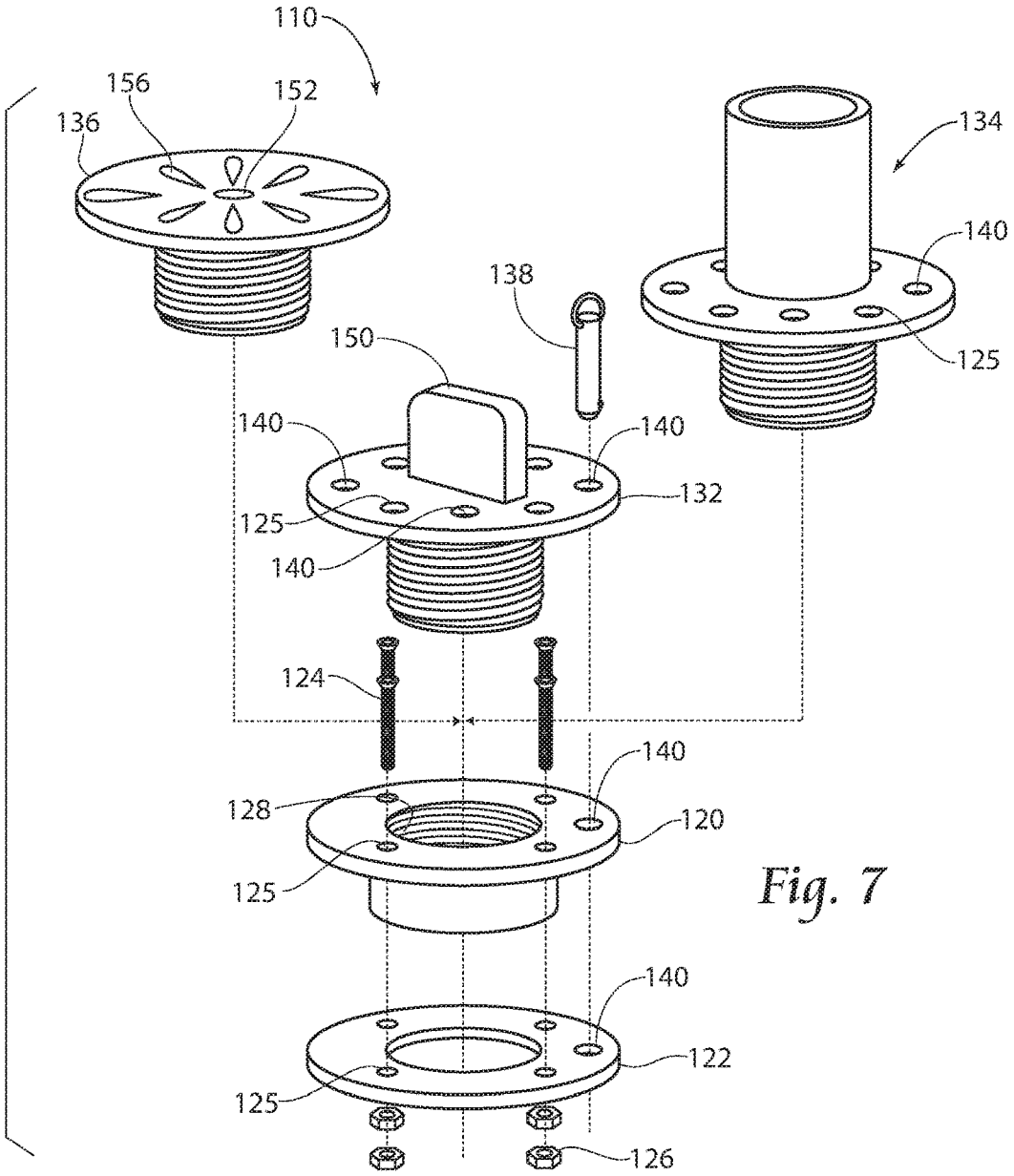
FIG. 7 is an exploded view of a first embodiment of the invention.
Figure 8:
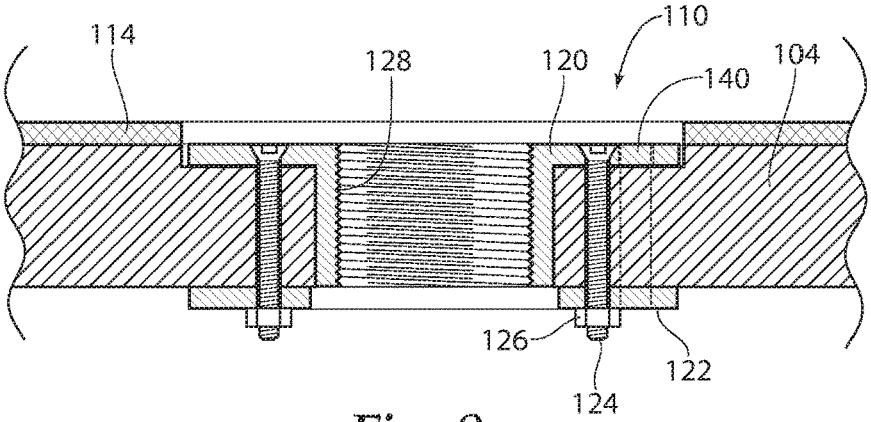
FIG. 8 is a cutaway side view of a receptacle.

As seen in FIGS. 7 and 8, receptacle 110 comprises a void in deck 104 through which a flange portion 120 and a backing ring 122 are connected to one another. Flange 120 is inserted into the deck side of deck 104 such that the top surface of flange 120 is essentially flush with deck 104. Backing ring 122 is installed on the bottom of deck 104 and securely mates with flange 120 by way of corresponding threaded fasteners 124 and 126.

Figure 12:
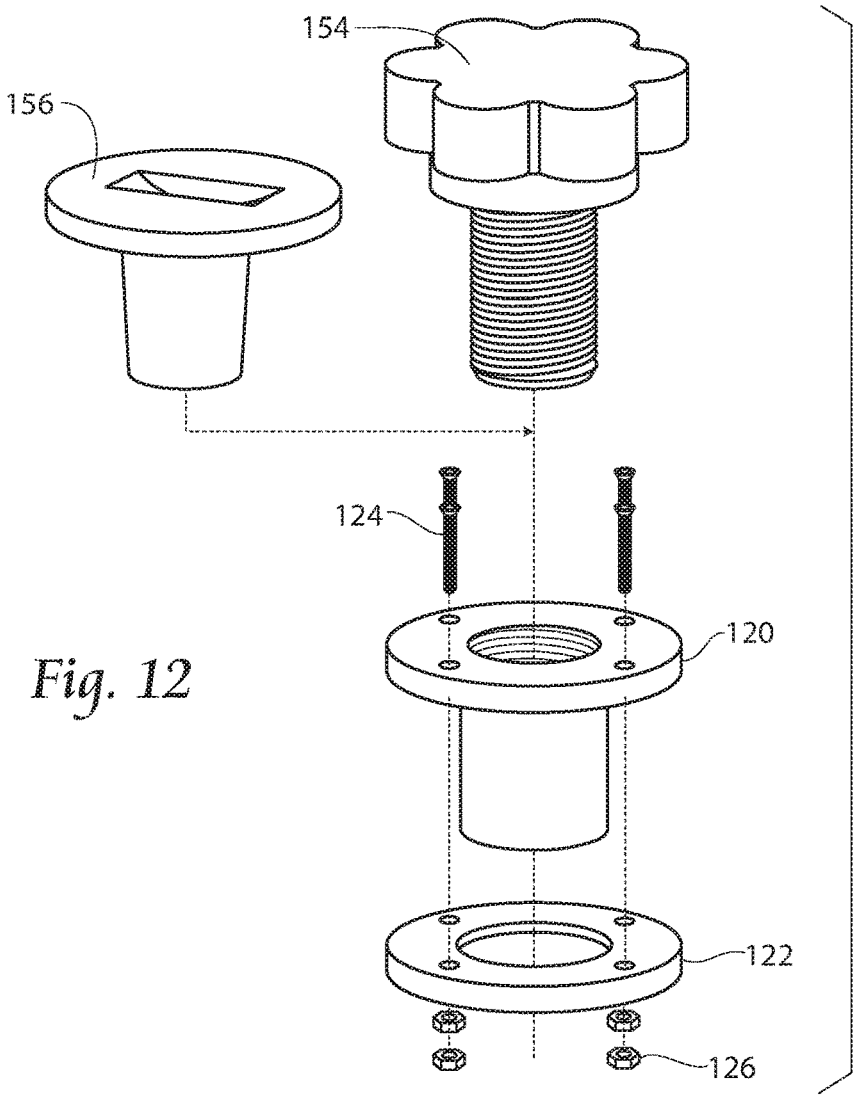
FIG. 12 is an exploded view of a second embodiment of the invention.
Figure 13:
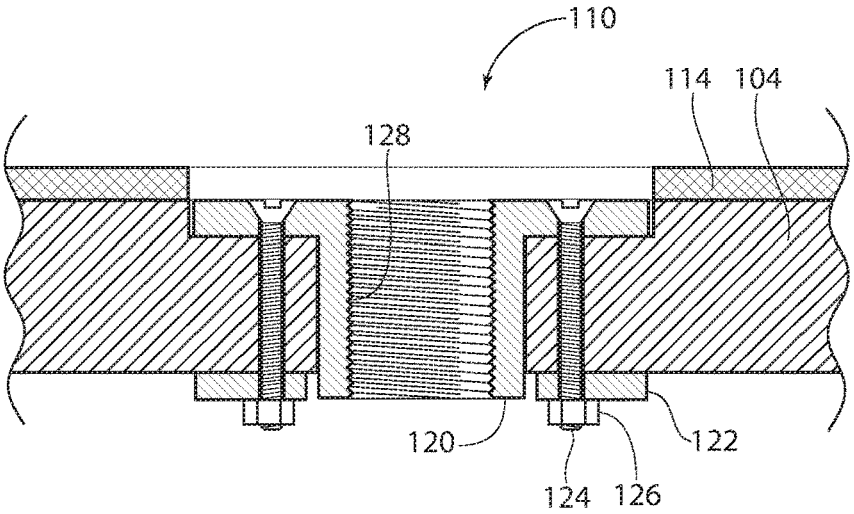
FIG. 13 is a cutaway side view of a receptacle.
Figure 14:
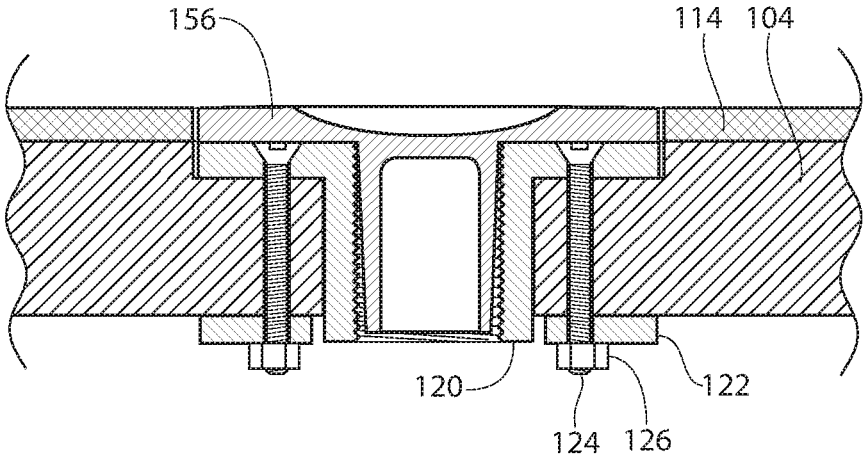
FIG. 14 is a cutaway side view of a plug insert seated in a receptacle.
Figure 15:
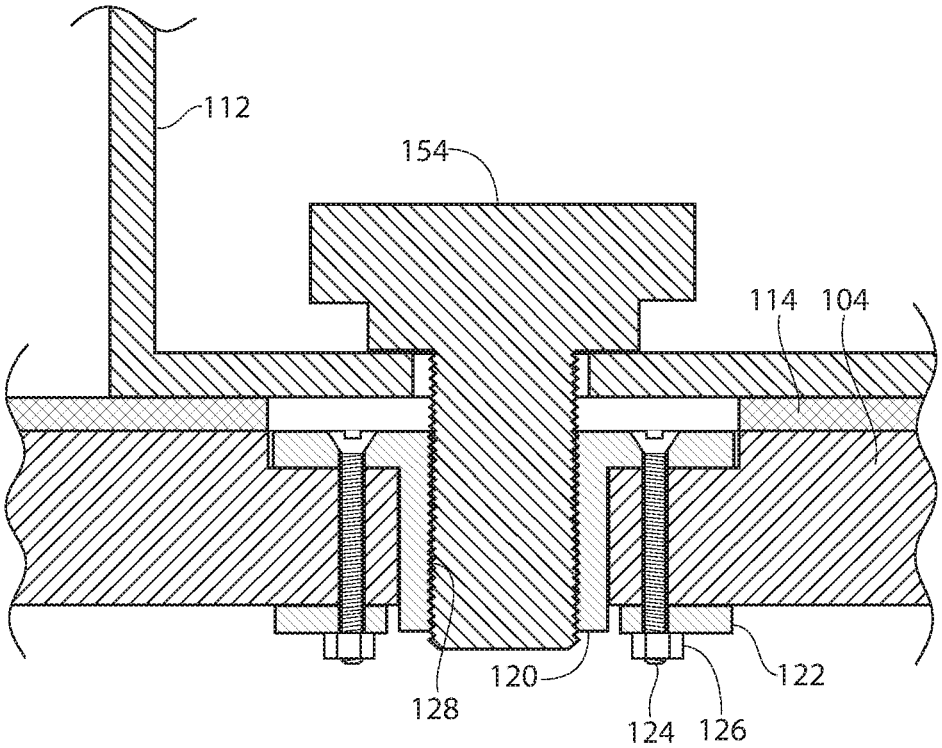
FIG. 15 is a cutaway side view of a tool-free hold down insert seated in a receptacle.
Figure 16:
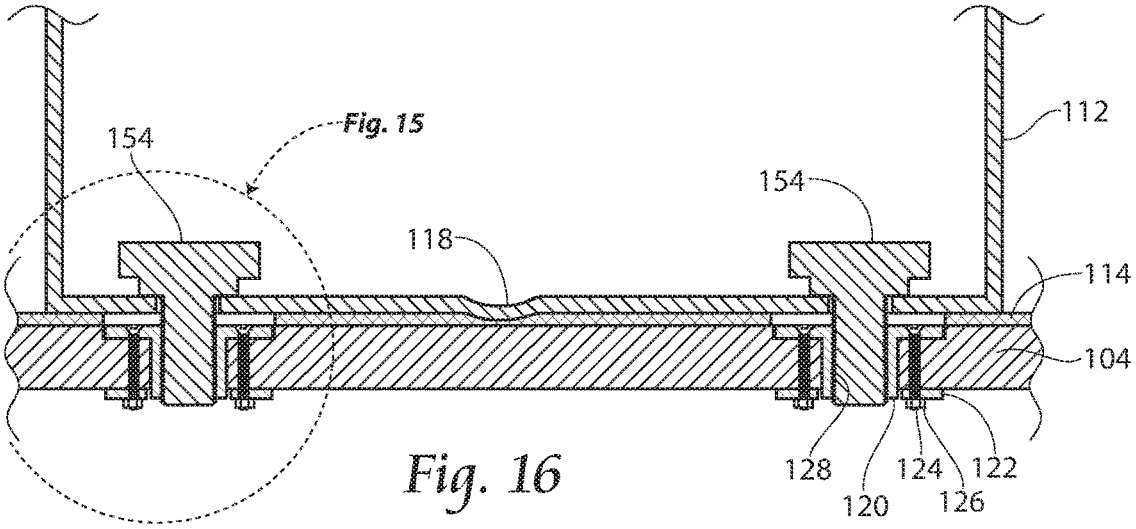
FIG. 16 is a cutaway side view of a module attached to the deck by way of tool-free hold down inserts.
Figure 17:
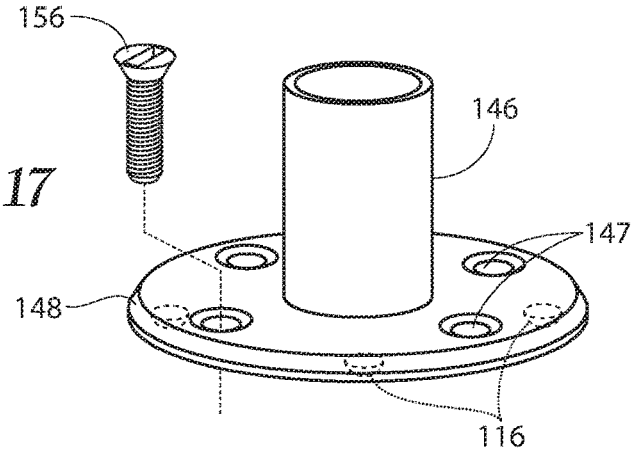
FIG. 17 is a perspective view of a pedestal insert of a second embodiment of the invention.
Figure 18:
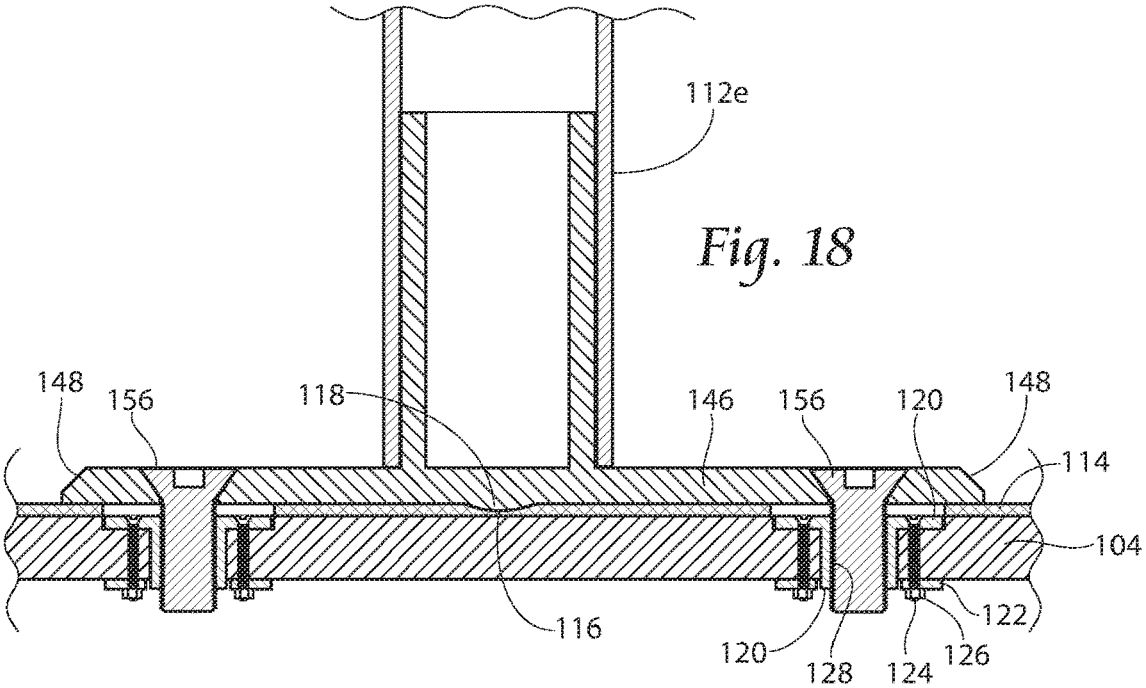
FIG. 18 is a cutaway side view of a pedestal insert seated in a receptacle.

Deck 104, deck covering 114, flange 120, and inserts 130 are generally flush with the plane of deck 104 or deck covering 114. Flange 120 may have a threaded interior diameter 128 into which one of a variety of inserts 130 may be screwed or otherwise secured. Options for inserts 130 shown in FIG. 7 include a hold down 132, a pedestal 134, and a plug 136. It is expected that a hold down 132 would be best suited for securing, for example, seat modules 112 for seating, while a pedestal 134 might be better for securing, for example, a module 112 comprising a stool or table. Plug 136 is provided to fill in receptacles 110 when no module 112 is inserted therein. Plug 136 is generally flush with deck covering 114. Instead of having a threaded interior, plug 136 may be provided with another type of fastening format, such as a press-fit such as shown in FIGS. 12 and 14.

Regardless of the type of insert 130, in cases where extra security against accidental rotation is needed, the present invention comprises a locking pin 138 and at least one locking retention aperture 140, such as shown in FIGS. 7, 8, 10, and 11 may be provided. Inserting pin 138 through one of apertures 140 permits module 112 to be rotated for desired insertion but prevents unwanted rotation of an installed module 112. Note that pin 138 also prevents module 112 from loosening during use. Pin 138 may incorporate a ball-detent 141, shown in FIG. 12, to further prevent loosening. Pin 138 could also be a threaded male knob or other securing structure.

In the second embodiment, there may be multiple receptacles 110 in each segment 108 which, though are generally constructed in the same manner as seen in FIGS. 12-18 will vary in size from the receptacles 110 of the first embodiment shown in FIGS. 7-11. However, as seen in FIG. 6C, are secured to deck 104 through the interior of modules 112. In addition, use of multiple receptacles 110 in a segment 108 eliminates the need for anti-rotation features. Deck covering 114 may be made of a resilient material and may thus increase gripping power.

Figure 10:
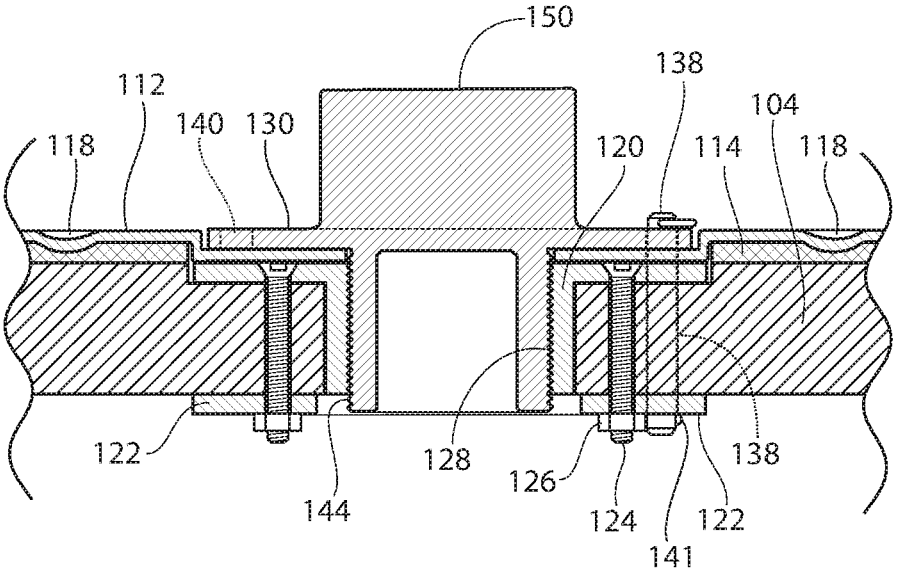
FIG. 10 is a cutaway side view of a tool-free hold down insert seated in a receptacle.
Figure 11:
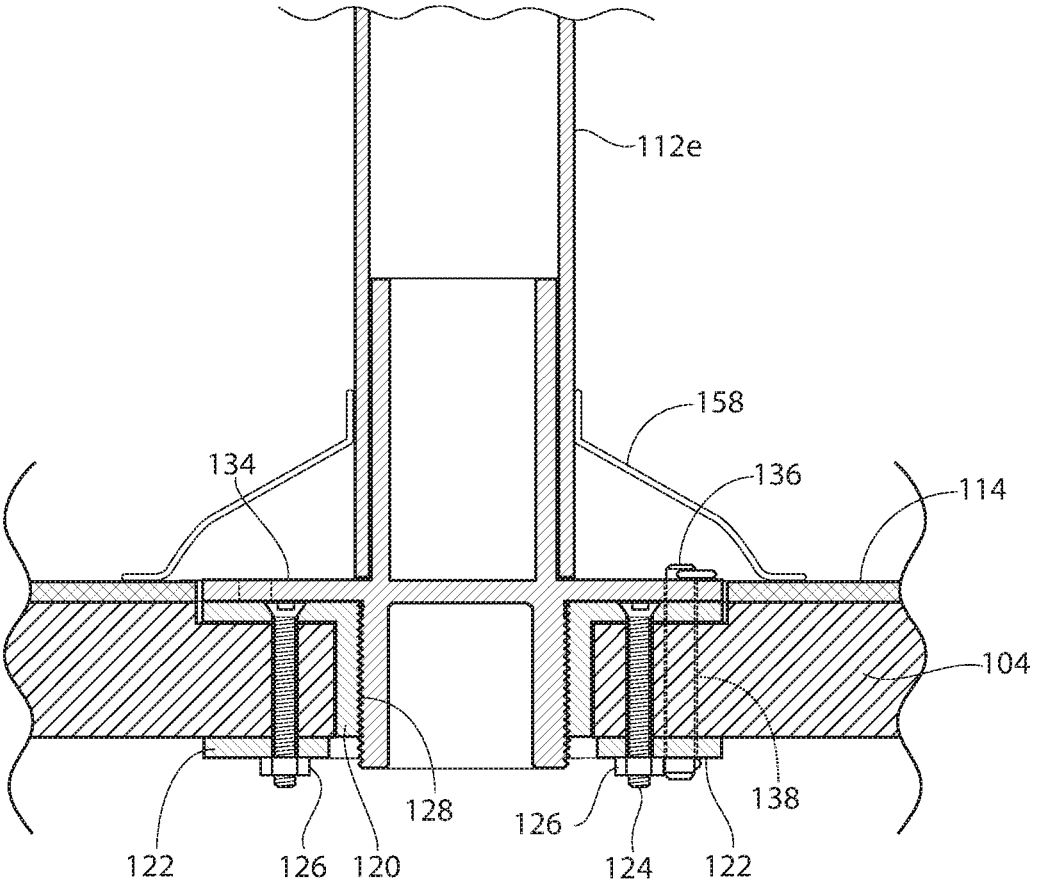
FIG. 11 is a cutaway side view of a pedestal insert seated in a receptacle.

As seen in FIGS. 6B and 6C, modules 112 may also optionally be provided with feet 116 to further balance modules 112 and secure them against deck covering 114. Referring to FIG. 10, deck covering 114 may be provided with depressions 118 to accept feet 116 or depressions 118, if present, may be caused by suitable tightening of modules 112 against resilient deck covering 114.

Figure 9:
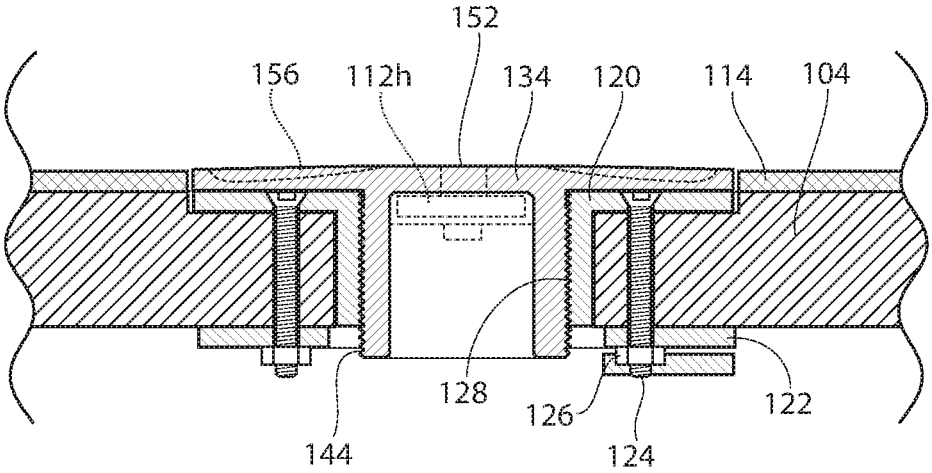
FIG. 9 is a cutaway side view of a plug insert seated in a receptacle.

Due to the flush nature of plug 136, some kind of removal feature is contemplated. These may include depressions or openings 156 such as those shown in plugs 136, as seen in FIGS. 7 and 9, to provide a grip for installation. Plugs 136 could incorporate a small solar panel or other appropriate light system 112H, as shown in FIGS. 5C and 19, to provide ambient lighting.

A method of the present invention is contemplated in which the manufacture, shipping, and storage of modules is streamlined. Because modules 112 and inserts 130 are identical to one another and to correspondingly identical receptacles 110. The number of parts overall is reduced. Further, it is anticipated that customers will return for different modules, newer modules, and replacement modules. The present invention benefits manufacturers, wholesalers, retailers, customers, and other participants in the supply chain.

Within the scope of the invention are numerous other attachment types, including, among others, single and multiple receptacles, threaded and non-threaded module mounting structures, and quarter-turn type mounting structures. Understandably, any tool-free or tool-less modular attachments and attachment types are possible and also considered well within the scope of the invention.

For example, modular attachments need not match the shape or dimensions of a single insert. In addition, the invention can be modified in a number of known ways to secure modular boat modules within a receptacle or receptacles. All of these should likewise be considered within the scope of the invention.

I claim:

1. A boat having a deck comprising:

a plurality of cylindrical receptacles arranged in a grid pattern on said deck, said cylindrical receptacles having a flange, said flange having an opening;

at least one deck module comprising at least one receptacle insert and a corresponding backing ring for threadingly engaging one of said cylindrical receptacles and said flange without the use of tools said deck module comprising an opening;

and wherein said module is designed to be movable between said receptacles; and a pin insertable into said flange opening and said deck module opening to prevent rotation of said deck module.

2. The boat of claim 1, further comprising:

said deck having a plurality of apertures therein, wherein one of said receptacle flanges and a corresponding backing ring are mounted to the top and bottom sides of said deck to form a plurality of cylindrical receptacles within said apertures.

3. The boat of claim 2, further comprising: a resilient deck covering overlying said deck and having openings corresponding to said receptacles.

4. The boat of claim 3, wherein said receptacle insert is essentially flush with said deck or flush with said deck covering overlying said deck.

5. The boat of claim 1, wherein said receptacle insert comprises a plug.

6. The boat of claim 1, wherein said receptacle insert comprise, a hold down.

7. The boat of claim 1, wherein said receptacle insert comprises a pedestal.

8. A system for arranging boat deck modules comprising:

a plurality of cylindrical deck receptacles wherein each receptacle is essentially identical to each of the other receptacles, said cylindrical receptacles having a flange, said flange having an opening;

a resilient deck covering overlying said cylindrical receptacles, said deck covering have openings corresponding to said cylindrical receptacles and a plurality of deck modules, each of said modules comprising a cylindrical insert wherein each of said cylindrical inserts of said modules is configured to removably couple with a corresponding one of said receptacles through said deck covering, said deck module comprising an opening; and a pin insertable into said flange opening and said deck module opening to prevent rotation of said deck module.

9. The boat of claim 1 wherein said modules comprise resilient feet for balancing said module when secured to said receptacle.

10. The boat of claim 1 wherein said cylindrical receptacles are threaded.

11. The system of claim 8 wherein said modules further comprise feet, said feet engaging with said deck covering to provide balance for said modules when secured to said receptacle.

* * * * *